US005832723A

United States Patent [19]

Iwata et al.

[11] Patent Number: 5,832,723

[45] Date of Patent: Nov. 10, 1998

[54] ENGINE EXHAUST PIPE

[75] Inventors: Minoru Iwata, Snsono; Yoshiaki Ito, Chiryu; Kenichi Harada, Susono, all of Japan

[73] Assignee: Toyota Jidosha Kabushiki Kaisha, Toyota, Japan

[21] Appl. No.: 580,682

[22] Filed: Dec. 29, 1995

[30] Foreign Application Priority Data

Jan. 13, 1995 [JP] Japan ..... 7-004328
Oct. 27, 1995 [JP] Japan ..... 7-280925

[51] Int. Cl.[6] ..... F01N 7/10

[52] U.S. Cl. ..... 60/276; 60/322; 204/424; 204/427

[58] Field of Search ..... 60/276, 322; 204/424, 204/427

[56] References Cited

U.S. PATENT DOCUMENTS 3,768,259 10/1973 Carnahan ..... 60/276
4,617,795 10/1986 Abthoff ..... 60/276
4,747,624 5/1988 Faber et al. .
4,969,445 11/1990 Hertweck et al. .

FOREIGN PATENT DOCUMENTS 41 00 935 7/1992 Germany .
42 12 505 5/1993 Germany .
63-147520 9/1988 Japan .
6-10662 1/1994 Japan .
7-71243 3/1995 Japan .

*Primary Examiner*—Douglas Hart
*Attorney, Agent, or Firm*—Oliff & Berridge, PLC

[57] ABSTRACT

The exhaust pipe of an engine has a double-wall structure consisting of an inner pipe and an outer pipe, and the inner pipe is spaced from the outer pipe with a predetermined clearance (heat insulating layer). The exhaust pipe includes a fitting for connecting other parts. At this fitting portion, the outer pipe has a outer hole. Likewise, the inner pipe has an inner hole. A nipple is situated on the outer pipe around the edge of the outer hole and is fixed to the outer pipe. An oxygen sensor is fitted to the nipple, and it extends through the inner hole of the inner pipe. A seal which is provided between the oxygen sensor and the flat portion of the inner pipe slidably contacts the step and the flat portion such that the fitting is unaffected by unequal thermal expansion between the inner and outer pipes.

26 Claims, 14 Drawing Sheets

ENGINE EXHAUST PIPE

BACKGROUND OF THE INVENTION

1. Field of the Invention

The present invention relates generally to an exhaust pipe of an engine exhaust system. More particularly, the present invention relates to an exhaust pipe having a double-wall structure consisting of an inner pipe and an outer pipe.

2. Description of the Related Art

Exhaust pipes having a double-wall structure are well known and have been employed in exhaust systems of engines. There is one such type consisting of an outer pipe and an inner pipe, with an air gap between them. The double-wall structure has high heat insulating properties.

An oxygen sensor and other parts including pipes are sometimes attached to the exhaust pipe. In a double-wall exhaust pipe, these parts are fitted to a mounting nipple, or the like, fixed on the exhaust pipe. There is a method of securing nipples to the inner pipe and the outer pipe by welding. However, the temperatures of the inner pipe and the outer pipe are increased by the hot exhaust gas flowing through the inner pipe. Since the inner pipe is heated to a higher temperature than the outer pipe, a difference occurs in the thermal expansion between these two pipes. Accordingly, heat stress is generated where the nipple is welded, which may result in a defective bond between the nipple and the pipes.

Japanese Unexamined Utility Model Publication No. Sho 63-147520 discloses a structure, shown in FIG. 27, for fastening a nipple for preventing such problems. As shown in FIG. 27, an exhaust pipe 70 consists of an inner pipe 71 and an outer pipe 72 and has an intimate contact portion 73 where the outer wall surface of the inner pipe 71 is brought into intimate contact with the inner wall surface of the outer pipe 72. At this intimate contact portion 73, a nipple 75 for fitting other parts is immobilized in fitting holes 74 formed in each pipe 71, 72. These fitting holes 74 have different diameters. The nipple 75 is fixed such that a clearance exist between the nipple 75 and the wall surface of each hole 74. In this state, a flange 75*a* of the nipple 75 is fixed to the outer pipe 72 by welding, and thus the nipple 75 is fixed to the exhaust pipe 70.

According to the structure described above, while the inner pipe 71 and the outer pipe 72 contact each other at the intimate contact portion 73, they are not fixed to each other. Accordingly, the inner pipe 71 is permitted to move relative to the outer pipe 72 in the longitudinal direction to avoid heat stress where the nipple 75 is fixed. In addition, since the pipes 71, 72 contact each other at the intimate contact portion 73, the inner pipe 71 is airtight. Thus, the exhaust gas in the inner pipe 71 cannot leak into the space between the inner pipe 71 and the outer pipe 72.

However, in the exhaust pipe 70 described above, there is little or no air gap between the inner pipe 71 and the outer pipe 72 at and around the intimate contact portion 73. Accordingly, a large quantity of heat is transmitted from the exhaust gas passing through the inner pipe 71 to the outer pipe 72, and thus the heat insulating characteristics of the exhaust pipe 70 are reduced.

SUMMARY OF THE INVENTION

Accordingly, it is a primary objective of the present invention to provide an exhaust pipe of an engine having an outer pipe and an inner pipe, to which other parts including oxygen sensor are to be attached, wherein airtightness in the inner pipe can be secured without deteriorating heat insulating property of the exhaust pipe.

To achieve the foregoing and other objects and in accordance with the purpose of the present invention, an exhaust pipe having an outer pipe, an inner pipe extending in the outer pipe is provided. The inner pipe permitting a passage of exhaust gas therethrough. The outer pipe and the inner pipe respectively has an outer hole and inner hole aligned with each other. The outer pipe has an outer surface and an inner surface around an peripheral edge of the outer hole. The inner pipe has an outer surface and an inner surface around an peripheral edge of the inner hole. An outer surface of the inner pipe is separated from an inner surface of the outer pipe by a space along the substantially entire length of the inner pipe and the outer pipe. A cylindrical member secured to the outer pipe in alignment with the outer hole, and the cylindrical member has a connecting hole axially extending through the member to connect an external member with an inner space of the inner pipe. The connecting hole connects with the inner space of the inner pipe by way of the outer hole and the inner hole. The inner pipe is axially movable relative to the outer pipe based on a thermal expansion of the inner pipe resulted from the exhaust gas. The exhaust pipe comprises seal means for sealing between the inner hole and the outer hole. A seal means is interposed between the outer surface of the inner pipe around the peripheral edge of the inner hole and the external member inserted into the connecting hole. The seal means contacts the external member to seal between the inner hole and the outer hole. The seal means is arranged to facilitate the movement of the inner pipe relative to the outer pipe.

BRIEF DESCRIPTION OF THE DRAWINGS

The features of the present invention that are believed to be novel are set forth with particularity in the appended claims. The invention, together with the objects and advantages thereof, may best be understood by reference to the following description of the presently preferred embodiments together with the accompanying drawings in which:

DETAILED DESCRIPTION OF THE PREFERRED EMBODIMENTS

The first embodiment of the present invention will be described according to FIGS. 1–6.

Figure 6:
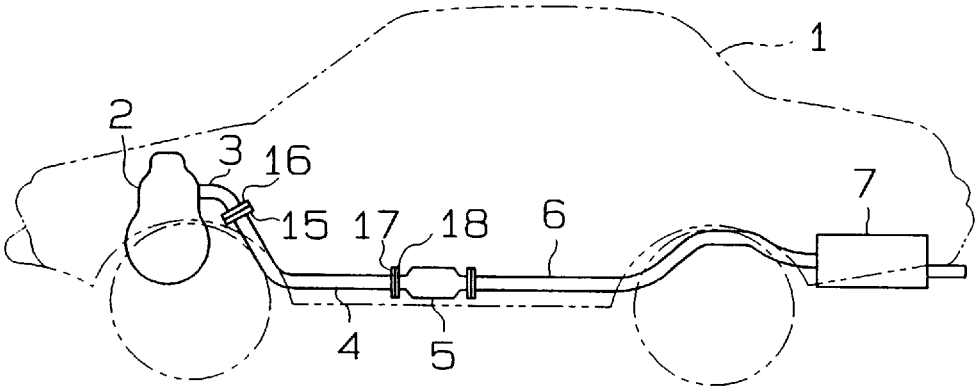
FIG. 6 is a diagrammatic view showing an engine and its exhaust system according to the first embodiment in an automobile.

FIG. 6 is a schematic view showing an engine 2 and an exhaust system of an automobile 1. The exhaust system includes members 3,4,5,6,7, which are connected to the engine 2 in this order from the front toward the rear of the automobile 1. An exhaust manifold 3 is connected to the engine 2. One end of an exhaust front pipe assembly 4 is connected to the manifold 3, and the other end is connected to a catalytic converter 5. An exhaust rear pipe 6 and a silencer 7 are successively connected to the downstream side of the catalytic converter 5.

The exhaust gas discharged from the engine 2 passes through the manifold 3 and pipe assembly 4 to be guided into the catalytic converter 5 where the exhaust gas is purified. The purified exhaust gas further passes through the rear pipe 6 and silencer 7 to be exhausted into the atmosphere.

Figure 3:
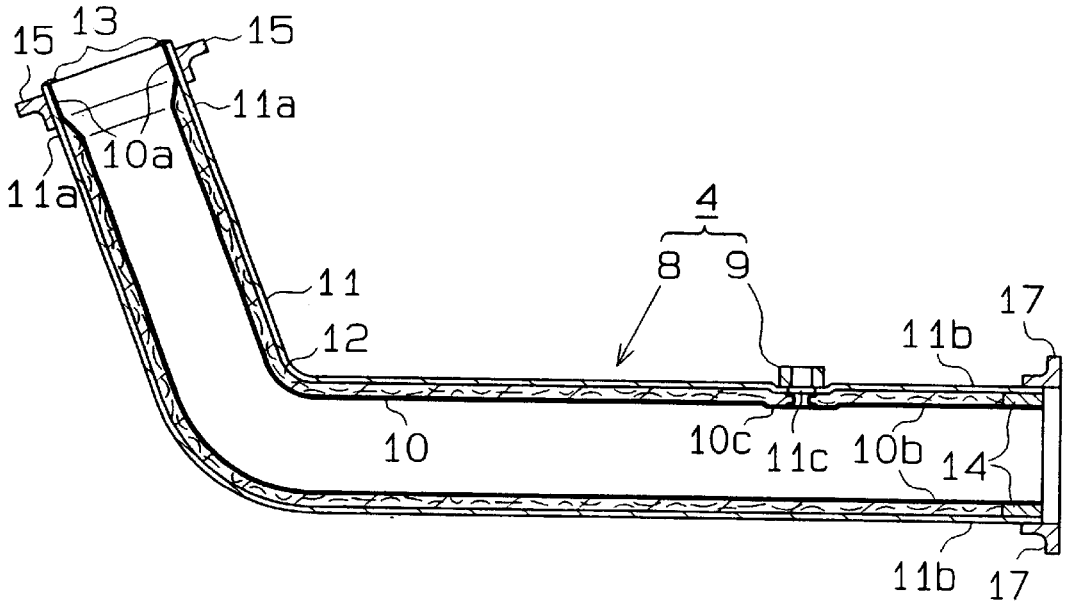
FIG. 3 is a side cross-sectional view of the pipe assembly according to the first embodiment.

As shown in FIG. 3, the pipe assembly 4 contains an exhaust front pipe 8 and a nipple 9 fixed to the pipe 8. The nipple 9 is for fitting other parts to the front pipe 8. The front pipe 8 is bent and has a cylindrical outer pipe 11 and a smaller diameter inner pipe 10 situated in the outer pipe 11 with a predetermined space being secured between them. A heat insulating layer 12 fills the space defined between the inner pipe 10 and the outer pipe 11. The heat insulating layer 12 contains an inorganic fiber heat insulating material such as glass wool or ceramic wool. Thus, the front pipe 8 has a three-layer structure consisting of the inner pipe 10, the outer pipe 11 and the heat insulating layer 12. The outer pipe 11 has a wall thickness at least equal to that of prior art pipes (e.g. 1.5 mm) for. adequate mechanical strength, and the wall thickness of the inner pipe is thinner than that of the outer pipe 11 (e.g., 0.6 mm).

Figure 4:
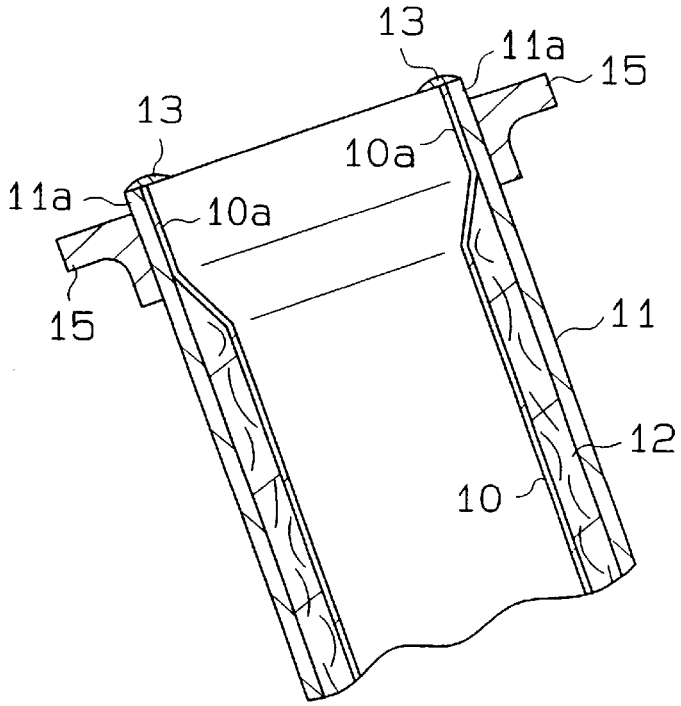
FIG. 4 is an enlarged cross-sectional view of the upstream end portion of a front pipe according to the first embodiment.
Figure 5:
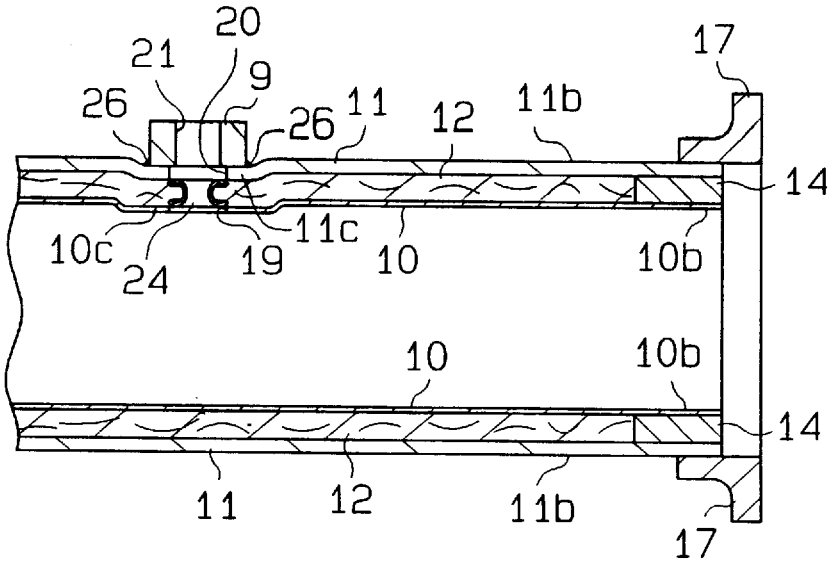
FIG. 5 is an enlarged cross-sectional view of the downstream end portion of the front pipe according to the first embodiment.

As shown in FIGS. 3 and 4, at the upstream end portion of the pipe assembly 4, an expanded upstream end portion 10*a* of the inner pipe 10 abuts against the inner surface of the upstream end portion 11*a* of the outer pipe 11, and these portions 10*a*, 11*a* are welded to each other by the welds 13. This welding restricts relative movement of these portions 10*a*, 11*a*. Meanwhile, as shown in FIGS. 3 and 5, at the downstream end of the pipe assembly 4, a downstream end portion 10*b* of the inner pipe 10 and a downstream end portion 11*b* of the outer pipe 11 are not welded to each other, but a mesh ring 14 occupies the space defined between them. This permits relative movement of these portions 10*b*, 11*b*. In other words, the inner pipe 10 is bonded to the outer pipe 11 at the upstream end portion 10*a* only, and the downstream end portion 10*b* of the pipe 10 is free to move longitudinally.

As shown in FIGS. 3, 4 and 6, a flange 15, which is fixed to the upstream end portion 11*a* on the outer surface of the outer pipe 11, is fastened to a flange 16 provided on the manifold 3 by fasteners (not shown). As shown in FIGS. 3, 5 and 6, another flange 17, which is fixed to the downstream end portion 11*b* on the outer surface of the outer pipe 11, is fastened to a flange 18 provided on the catalyst converter 5 by fasteners (not shown).

Figure 1:
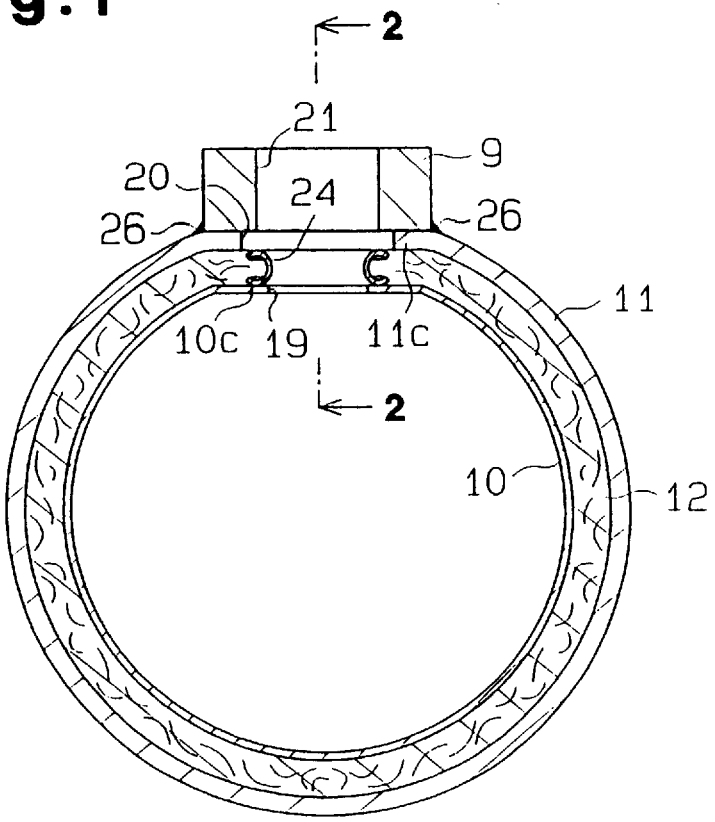
FIG. 1 is a cross-sectional view of a pipe assembly according to a first embodiment of the invention.
Figure 2:
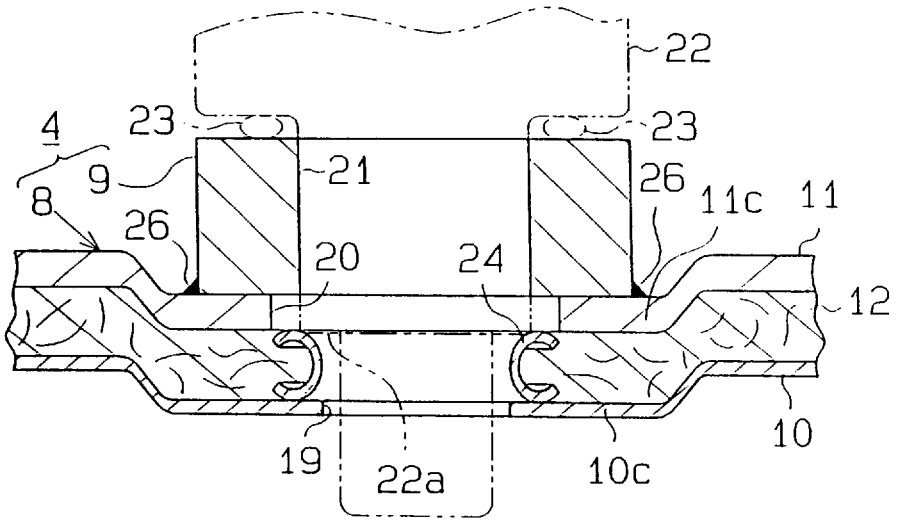
FIG. 2 is a cross-sectional view taken along the line 2—2 of FIG. 1.

Next, the fitting structure of the nipple 9 will be described. As shown in FIG. 5, the inner pipe 10 and the outer pipe 11 have flat portions 10*c*, 11*c*, respectively, opposing each other on the downstream part of the front pipe 8. As shown in FIG. 2, these flat portions 10*c*, 11*c* oppose At the flat portion 10*c*, an annular seal ring 24 having a C-shaped cross section is positioned around the periphery of the inner hole 19. This seal ring 24 is preferably made of heat resistant stainless steel and is resilient, due to its shape, in the axial direction (vertical direction in FIG. 2).

The nipple 9 is substantially cylindrically shaped and has a connecting hole 21 at its center, and the connecting hole 21 has female threads (not shown) formed on its inner surface. The nipple 9 is placed on the flat portion 11*c* with its connecting hole 21 aligned with the outer hole 20 of the outer pipe 11 and is fixed at its lower peripheral portion onto the outer pipe 11 by a weld 26.

As shown in FIG. 2, an oxygen sensor 22 is placed in the connecting hole 21 of the nipple 9. A seal ring 23, which is between the oxygen sensor 22 and the nipple 9, seals the clearance between the sensor 22 and the nipple 9. Male threads (not shown) formed on the outer circumference of the oxygen sensor 22 engage with the threads of the connecting hole 21 to connect the oxygen sensor 22 to the nipple 9. According to this structure, the oxygen sensor 22 is fixed with the nipple 9 to the outer pipe 11 only. The inner end of the oxygen sensor 22 protrudes through the inner hole 19 into the inner pipe 10 and is exposed to the exhaust gas flowing through the pipe 10.

The seal ring 24 is slidably retained between a step 22*a* of the oxygen sensor 22 and the flat portion 10*c* around the periphery of the inner hole 19. Since the seal ring 24 is deformable like a spring, it makes intimate contact with the flat portion 10*c* around the peripheral edge of the inner hole 19 and with the step 22*a*. Thus, the inner hole 19 is sealed by the seal ring 24 and the oxygen sensor 22.

The operation of the above structure will now be described. The exhaust gas discharged from the engine 2 passes through the manifold 3 and flows through the inner pipe 10 of the pipe assembly 4. Since the inner pipe 10 has a relatively small thickness and small heat capacity, it is heated readily by the exhaust gas.

Meanwhile, the outer pipe 11 is spaced from the inner pipe 10, and the heat insulating layer 12 is between these pipes 10 and 11. Further, these pipes 10, 11 are not brought into contact with each other even at the flat portions 10*c*, 11*c*, and some insulation 12 is also between these portions 10*c* and 11*c* as shown in FIG. 2. Accordingly, heat transfer is impended from the exhaust gas flowing through the inner pipe 10 to the outer pipe 11, and thus the temperature of the outer pipe 11 is maintained at a low level compared with that of the inner pipe 10.

The temperature difference between these pipes 10 and 11 causes a difference in thermal expansion. The pipes 10, 11 are bonded to each other at the upstream end portions 10*a*, 11*a*, so that longitudinal movement of the inner pipe 10 relative to the outer pipe 11 attributed to such difference in the thermal expansion is permitted. If the inner pipe 10 moves relative to the outer pipe 11, the seal ring 24 slides between and along the step 22*a* of the oxygen sensor 22 and the flat portion 10*c* while maintaining intimate contact with the flat portion 10*c* around the periphery edge of the inner hole 19. Specifically, movement of the inner pipe 10 relative to the outer pipe 11 at the portion where the oxygen sensor 22 is fixed does not interfere with the seal ring 24, and the inner pipe 10 is maintained airtight by the seal ring 24.

Further, movement of the inner pipe relative to the outer pipe 11 due to thermal expansion occurs not only in the longitudinal direction but also in the radial direction. Since the seal ring 24 is resilient in the radial direction of the inner pipe 10, the difference in the thermal expansion between these pipes 10 and 11 is absorbed by the elastic deformation of the seal ring 24.

In this embodiment, relative movement of these pipes 10, 11 in the longitudinal direction and in the radial direction at the location of the oxygen sensor 22 is compensated for by the seal ring 24. Accordingly, heat stress does not act on the nipple 9 or the weld 26.

In this embodiment, even if the seal ring 24 moves relative to the inner pipe 10 and the oxygen sensor 22, it maintains intimate contact with these members 10, 22. Further, the heat insulating material in the heat insulating layer 12 is sealed within the layer 12. Accordingly, exhaust gas never leaks into the heat insulating layer 12 or to the outside of the outer pipe 11.

In this embodiment, elastic deformation of the seal ring 24 urges it into contact with the portion around the periphery of the inner hole 19 between the step 22*a* and the flat portion 10*c*. In that respect, the sealing property of the seal ring 24 between the flat portions 10*c* and 11*c* is improved. Consequently, an airtight seal is accomplished preventing the exhaust gas from leaking outside.

Since the oxygen sensor 22 is fitted to the outer pipe 11, which undergoes less thermal expansion than the inner pipe 10, there is no need of considering positional change of the oxygen sensor 22 attributed to thermal expansion in designing the pipe assembly 4, so that, for example the length of a wiring harness to be connected to the sensor 22 can be that much reduced. Further, since the temperature of the outer pipe 11 is maintained at a lower level than that of the inner pipe 10, the weld 26, where the nipple 9 is welded to the outer pipe 11, is not damaged by heat. Accordingly, the portion of the oxygen sensor 22 that contacts the nipple 9 need not be made of a special heat-resistant material.

The nipple 9 is easily attached because it is welded onto the outer pipe 11 only. Accordingly, the steps of mounting the oxygen sensor including the nipple 9 to the pipe assembly 4 are reduced, leading to a reduction in production costs.

Next, a second embodiment of the present invention will be described. In any of the following embodiments including the second embodiment, similar components to those in the first embodiment are given with the same reference numbers, and a detailed description of them is omitted.

Figure 7:
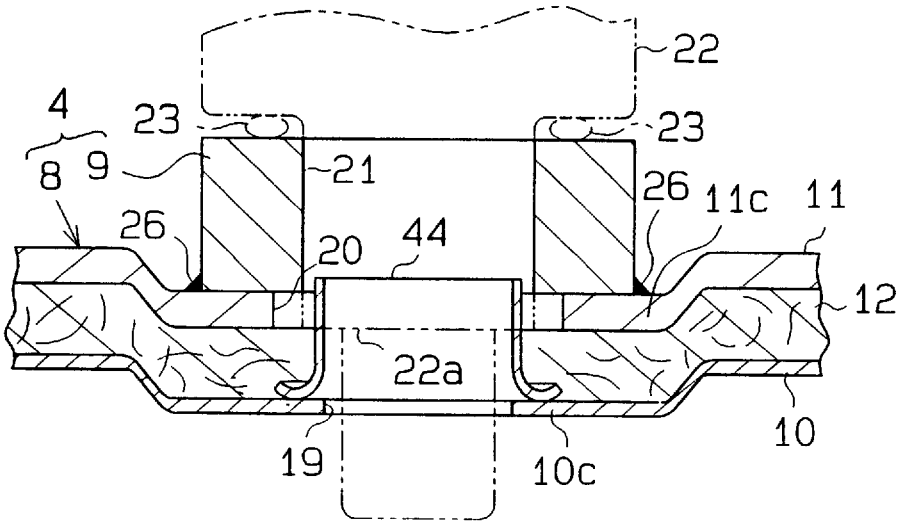
FIG. 7 is an enlarged cross-sectional view of the pipe assembly according to a second embodiment of the invention.

As shown in FIG. 7, what is different in this embodiment is a seal ring 44 located where the oxygen sensor 22 is fitted in place of the seal ring 24 employed in the first embodiment. This seal ring 44 has a substantially tubular shape, and its upper end portion is fitted in an annular groove (not shown) defined in the step 22*a* of the oxygen sensor 22. The lower end of the seal ring 44 is curved outward, and its curved face slidably contacts the flat portion 10*c* around the periphery of the inner hole 19. This seal ring 44, like the seal ring 24 in the first embodiment, is resilient in the axial (the vertical direction in FIG. 7) due to its shape.

The construction of this embodiment operates like the first embodiment. When the inner pipe 10 moves relative to the outer pipe 11 due to thermal expansion, the lower end portion of the seal ring 44 slides along the flat portion 10*c* which maintaining intimate contact with it. Accordingly, movement of the inner pipe 10 relative to the outer pipe 11 does not interfere with the nipple. The second embodiment enjoys the following benefits in addition to those of the first embodiment.

In the second embodiment, the upper portion of the seal ring 44 is fitted in the annular groove of the oxygen sensor 22, so that the seal ring 44 can be positioned easily with respect to the flat portion 10*c*, and the procedure of assembling the apparatus is simplified.

Figure 8:
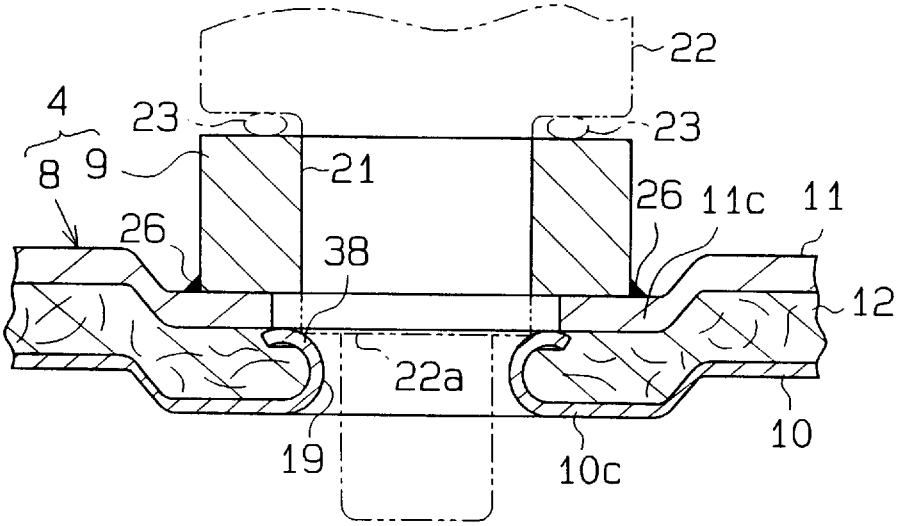
FIG. 8 is an enlarged cross-sectional view of the pipe assembly according to a third embodiment of the invention.

Next, a third embodiment of the present invention will be described. As shown in FIG. 8, that difference in this from the foregoing embodiments is a sealing lip 38 used instead of the seal rings 24, 44 at the location where the oxygen sensor 22 is to be fitted. In this embodiment, the edge of the inner hole 19 is arcuately curved toward the heat insulating layer 12 to form the sealing lip 38. The upper part of the sealing lip 38 slidably contacts the step 22*a* of the oxygen sensor 22. The sealing lip 38, like the seal ring 24 in the first embodiment, is elastically deformable in the axial direction (vertical direction in FIG. 8) due to its shape.

The third embodiment operates in a manner similar to the first and second embodiments. Further, when the inner pipe 10 moves relative to the outer pipe 11 due to thermal expansion, the upper curved part of the sealing lip 38 slides along the step 22*a* of the oxygen sensor 22, so that relative movement of the inner pipe 10 does not cause interference. Accordingly, the third embodiment of the invention enjoys the following benefits in addition to those of the first embodiment.

In the third embodiment, since the sealing lip 38 is formed integrally with the inner pipe 10, there is one less joint through which exhaust gas may leak, and thus the sealing integrity and reliability are improved.

Since the sealing lip 38 is formed integrally with the inner pipe 10 in this embodiment, the number of parts constituting the pipe assembly 4 is reduced.

Figure 9:
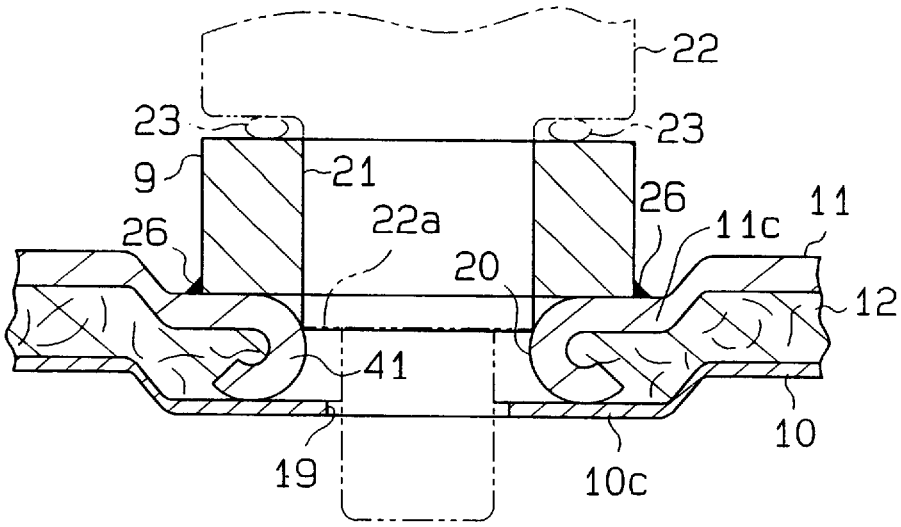
FIG. 9 shows in enlarged cross-sectional view a variation of the pipe assembly according to the first to third embodiment.

Incidentally, the third embodiment can be modified as shown in FIG. 9. Specifically, a sealing lip 41 is formed integrally with the outer pipe 11 instead of forming the sealing lip 38 integrally with the inner pipe 10 as shown in FIG. 8. More specifically, the edge of the outer hole 20 at the flat portion 11*c* is arcuately curved toward the heat insulating layer 12 to form the sealing lip 41. The lower part of the sealing lip 41 slidably contacts the flat portion 10*c* around the edge of the inner hole 19. The contact by the sealing lip 41 seals the inside of the inner pipe 10 and the heat insulating layer 12 to ensure airtightness. The step 22*a* of the oxygen sensor 22 abuts against the sealing lip 41. Accordingly, the operation and benefits of third embodiment are the same in this modification.

Figure 10:
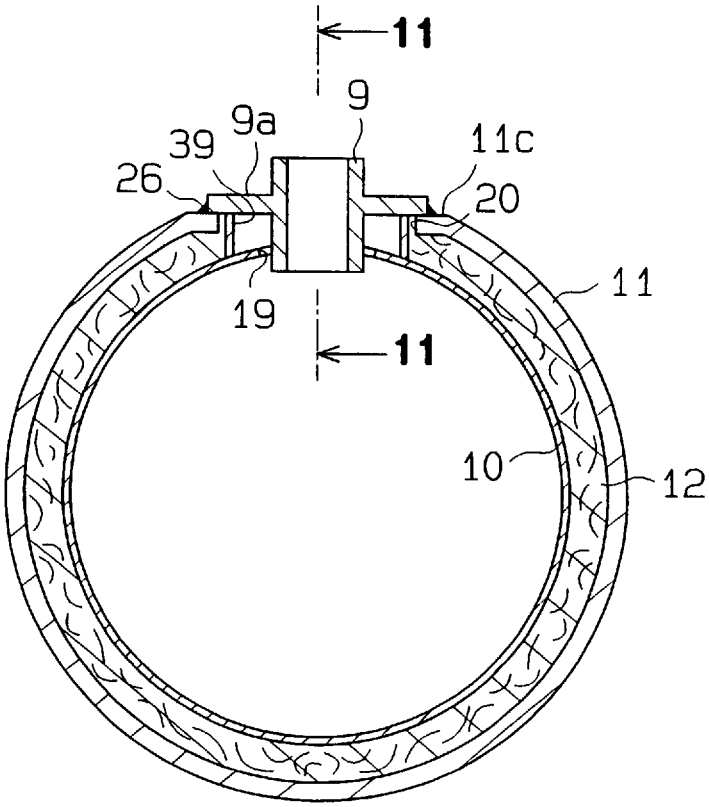
FIG. 10 is a cross-sectional view of a pipe assembly according to a fourth embodiment of the invention.
Figure 11:
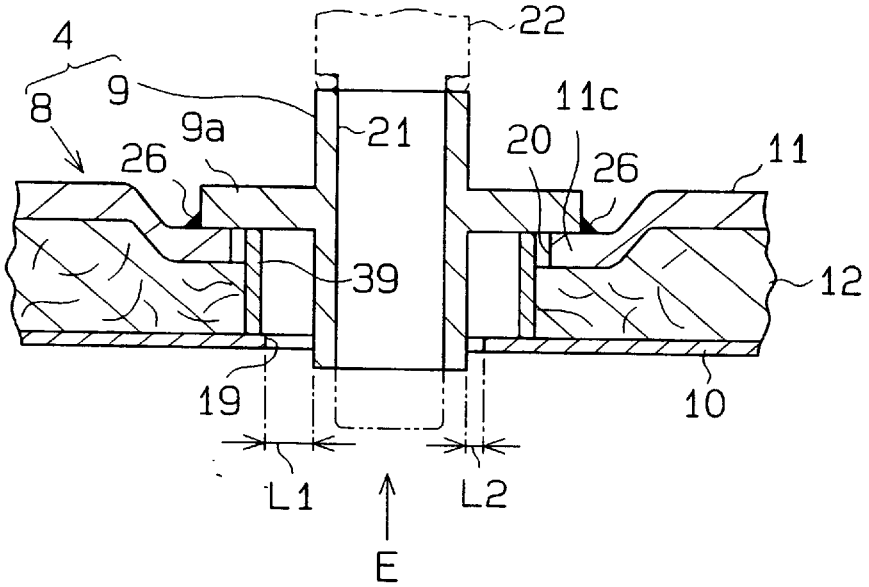
FIG. 11 is a cross-sectional view taken along the line 11—11 in FIG. 10.

Next, a fourth embodiment of the present invention will be described. As shown in FIGS. 10 and 11, the inner pipe 10 has no flat portion 10*c*, but the outer pipe 11 has a flat portion 11*c*. A wire mesh ring 39 is placed within inserted to the outer hole 20 of the flat portion 11*c*, and the lower part of the ring 39 rests on the inner pipe 10 around the edge of the inner hole 19.

In the embodiment of FIGS. 10 and 11, the nipple 9 has a substantially cylindrical shape and has a flange 9*a* formed on its outer surface. The nipple 9 is positioned inside the ring 39, and the lower face of the flange 9*a* rests against the flat portion 11*c* as seen in FIGS. 10 and 11. The flange 9*a* is welded around its edge to the flat portion 11*c*, and the outer hole 20 is sealed by the weld 26. The lower end of the nipple 9 penetrates the inner hole 19 and extends into the inner pipe 10.

The ring 39 is retained between the lower face of the flange 9*a* and the outer surface of the inner pipe 10. The axial length (vertical dimension in FIGS. 10 and 11) of the ring 39 is greater than the maximum clearance between the inner pipe 10 and the flange 9*a*. Accordingly, the ring 39 is compressed and undergoes elastic deformation such that it makes intimate contact with the flange 9*a* and inner pipe 10. Particularly, as shown in FIGS. 10 and 11, the lower part of the ring 39 is elastically deformed to match the profile of the inner pipe 10.

Figure 12:
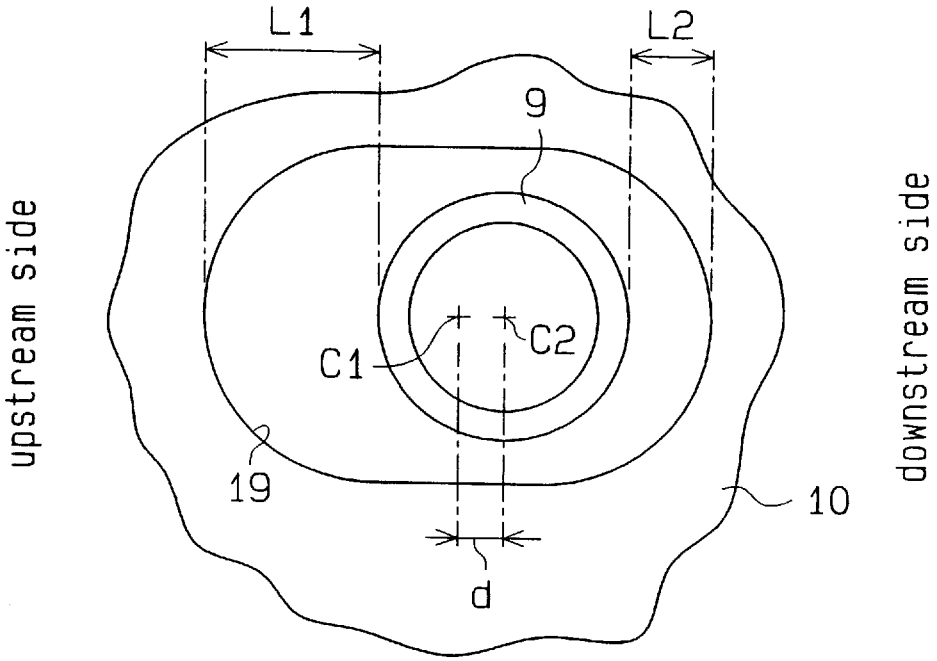
FIG. 12 is a view as seen from the direction indicated by the arrow E in FIG. 11.

In the embodiment of FIGS. 10 and 11, the inner hole 19 has a slot-like form extended in the longitudinal direction of the front pipe 8, as shown in FIG. 12. The center C1 of the inner hole 19 is offset by a predetermined value d from the center C2 of the outer hole 20 or of the nipple 9 toward the upstream end of the front pipe 8.

As shown in FIGS. 11 and 12, the clearance L1 on the upstream side of the front pipe 8 is greater than the clearance L2 on the downstream side of the pipe 8. The predetermined offset value d is suitably selected depending on the movement of the inner pipe 10 when heated such that the nipple 9 will never interfere with the inner hole 19.

The embodiment of FIGS. 10 and 11 enjoys the following benefits in addition to ensuring insulation of the pipe assembly 4 like in the first embodiment.

In this embodiment, the ring 39 is retained between the flange 9*a* and the inner pipe 10 and undergoes compressive elastic deformation such that it makes intimate contact with these members 9*a*, 10. Accordingly, airtightness of the inner pipe 10 is maintained by the ring 39, and the exhaust gas does not leak from the inner pipe 10 into the insulating layer 12. Further, the ring 39 seals the heat insulating material in the insulating layer 12 to prevent insulating material from spilling out through the clearance between the pipes 10 and 11.

In this embodiment, since the ring 39 is slidable with respect to the nipple 9 and the inner pipe 10, relative movement of the inner pipe 10 does not cause interference when it moves relative to the outer pipe 11 due to thermal expansion. Elastic deformation of the ring 39 itself also permits such relative movement of the inner pipe 10. Accordingly, heat stress attributed to thermal expansion is avoided.

If displacement occurs between the pipes 10 and 11 in the radial direction of the front pipe 8 in attaching the nipple 9 to the outer pipe 11, such displacement will be absorbed by the elastic deformation of the ring 39. Accordingly, the procedure of assembling the pipe assembly 4 is simplified.

Since the ring 39 conforms to the shape of the inner pipe 10, there is no need to provide a flat portion on the inner pipe 10 so as to facilitate contact between these members 10 and 39. Generally, to subject an inner pipe and an outer pipe, each having a flat portion, to bending is liable to concentrate excess stress at these flat portions. Since the inner pipe 10 has no flat portion in this embodiment, such concentration of stress is avoided.

Figure 13:
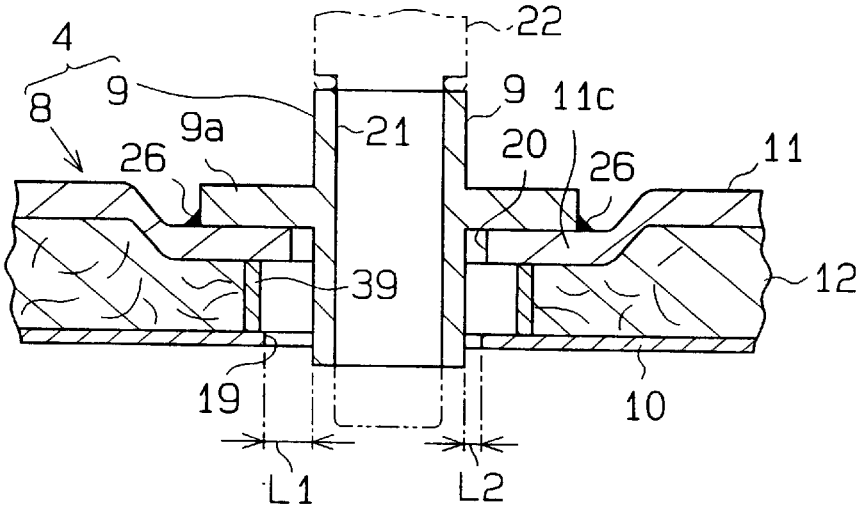
FIG. 13 shows as enlarged cross-sectional view of a variation of the pipe assembly according to the fourth embodiment.

The fourth embodiment of the invention can be modified as shown in FIG. 13. Though the ring 39 is retained between the flange 9*a* of the nipple 9 and the inner pipe 10 according to FIG. 11, the ring 39 may be retained between the area around the edge of the outer hole 20 and the area around the edge of the inner hole 19, as shown in FIG. 13.

Figure 14:
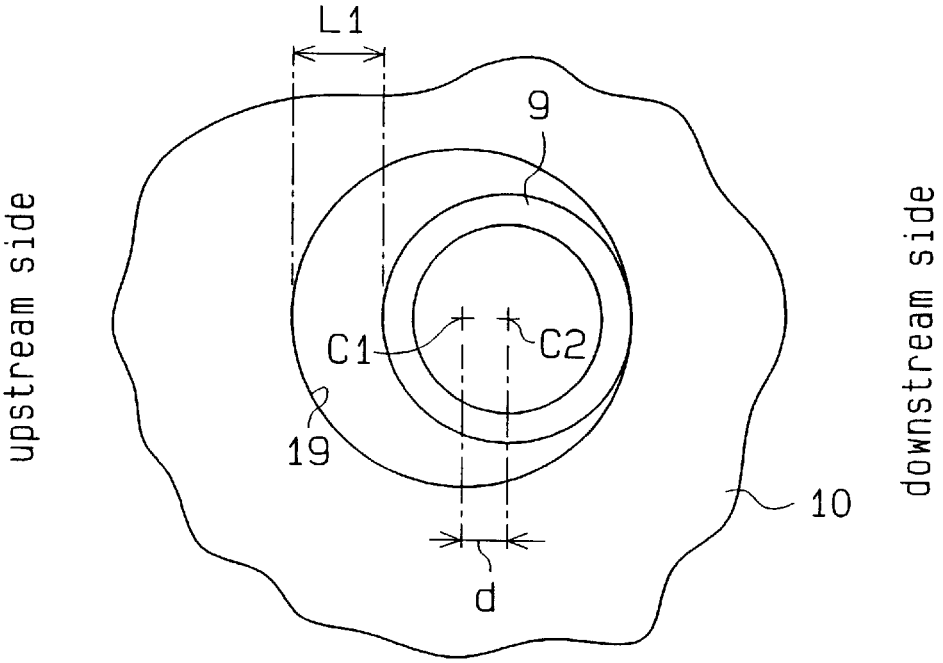
FIG. 14 is a variation of the shape of an inner hole according to the fourth embodiment as seen in the same direction as FIG. 12.

While the inner hole 19 has a slot-like form in the fourth embodiment, it may have a circular shape, as shown in FIG. 14. In this case, the center C1 of the inner hole 19 is offset from the center C2 of the nipple 9 by a predetermined value d to the upstream side of the front pipe 8. The downstream side of the nipple 9 abuts against the edge of the inner hole 19, and a clearance L1 exists between the upstream side of the nipple 9 and the edge of the inner hole 19. The area of the inner hole 19 can be further reduced by locating the clearance L1 on the upstream side of the front pipe 8 only, and further, the exhaust gas is prevented from passing from the inner pipe 10 through the ring 39 into the insulating layer 12.

In this embodiment, when the inner pipe 10 undergoes thermal expansion with respect to the outer pipe 11 in the longitudinal direction, its expansion is always greater than in the outer pipe 11, so that the inner pipe 10 moves downstream relative to the outer pipe 11. Accordingly, movement of the inner pipe 10 due to thermal expansion relative to the outer pipe 11 does not cause interference even in the construction of FIG. 14 where the nipple 9 abuts against the inner edge of the inner hole 19.

Figure 15:
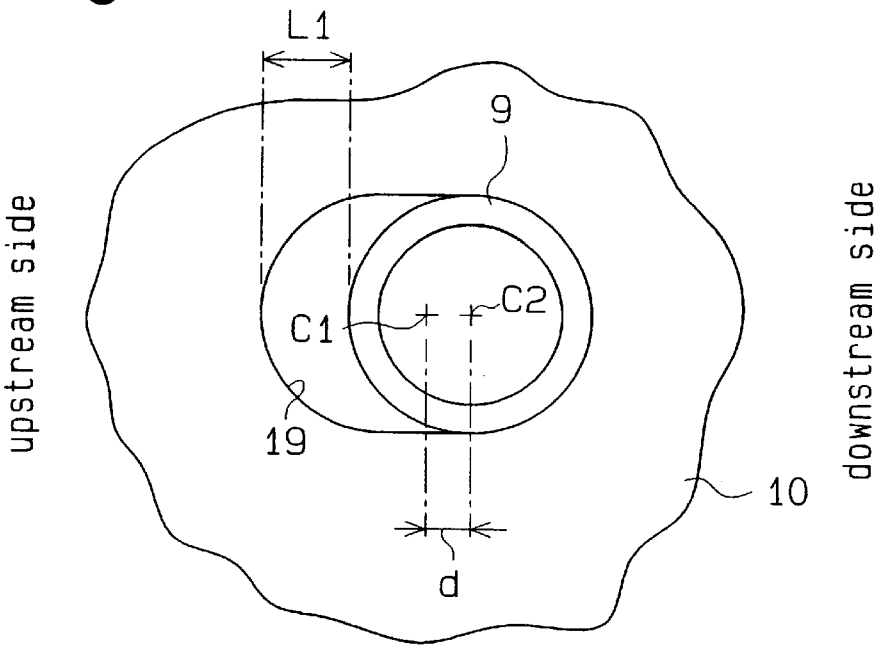
FIG. 15 is another variation with respect to the shape of an inner hole according to the fourth embodiment as seen in the same direction as FIG. 12.

Thus, in this embodiment, the inner hole 19 shown in FIG. 12 may be modified as shown in FIG. 15 with the clearance L1 existing on the downstream side of the front pipe 8 so as to reduce further the area of the inner hole 19.

Figure 16:
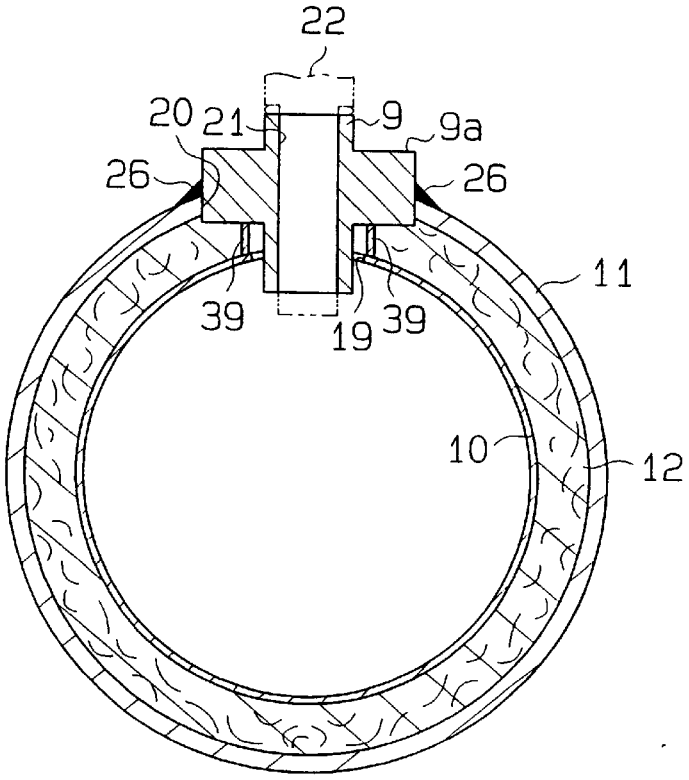
FIG. 16 is a cross-sectional view of a pipe assembly according to a fifth embodiment of the invention.

Next, a fifth embodiment of the present invention will be described referring mainly to its differences with respect to the fourth embodiment. As shown in FIG. 16, both the inner pipe 10 and the outer pipe 11 have no flat portions 10*c*, 11*c*. The diameter of the outer hole 20 in the outer pipe 11 is substantially the same as the outer diameter of the flange 9*a*. The nipple 9 is placed within the inner hole 19, and the outer edge of the flange 9*a* is welded along the edge of the outer hole 20 to seal the nipple 9 and the outer hole 20 with the weld 26. The ring 39 is slidably retained between the flange 9*a* and the inner pipe 10 around the edge of the inner hole 19.

The construction of this embodiment has the following advantage. Since the pipes 10, 11 do not have flat portions, there is no need to consider concentration of stress at the flat portions when the pipes 10, 11 are subjected to bending.

Figure 17:
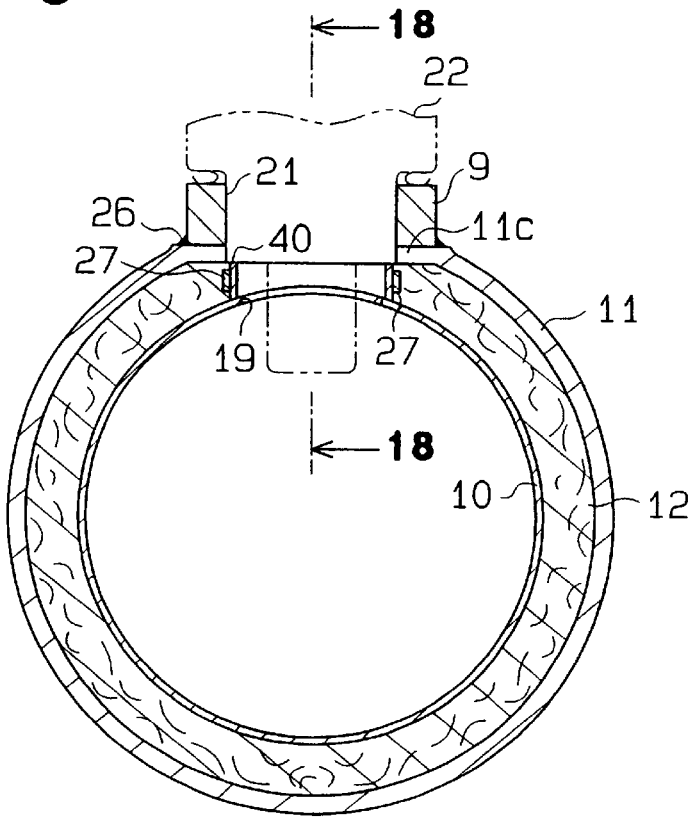
FIG. 17 is a cross-sectional view of a pipe assembly according to a sixth embodiment of the invention.
Figure 18:
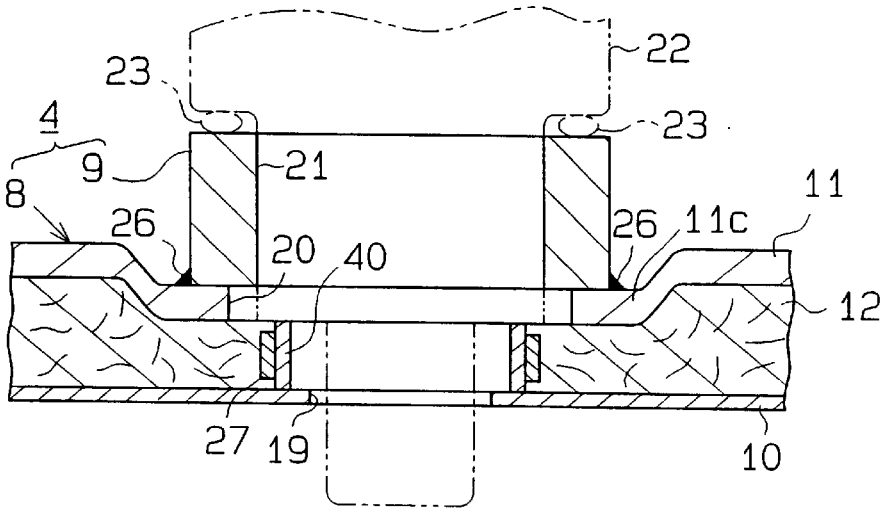
FIG. 18 is a cross-sectional view taken along the line 18—18 in FIG. 17.

Next, a sixth embodiment of the present invention will be described referring mainly to its differences with respect to the first embodiment. In this embodiment, as shown in FIGS. 17 and 18, a wire mesh ring 40 like that of the fifth embodiment is used in place of the seal ring 24 employed in the first embodiment. As shown in FIG. 17, the inner pipe 10 has no flat portion 10*c*.

The ring 40 is located around the edge of the inner hole 19 and is retained between there and the step 22*a* of the oxygen sensor 22. The ring 40 undergoes compressive elastic deformation to be slidable and to make intimate contact with the inner pipe 10 and the oxygen sensor 22. In this embodiment, a metal ring 27 is fitted on the outer surface of the ring 40. The axial length (vertical length in FIG. 18) of the ring 27 is smaller than the minimum clearance between the inner pipe 10 and the step 22*a* of the oxygen sensor 22.

The construction of this embodiment has the following benefit in addition to those in the first and fourth embodiments.

Since the exhaust gas passing through the inner pipe 10 is hot, heat will be transmitted via the ring 40 to the heat insulating layer 12 and to the outer pipe 11. In this embodiment, the ring 27 applied on the outer surface of the wire mesh ring 40 increases heat capacity of the ring 40, so that heat transmission to the respective members 12, 11 is moderated. Accordingly, the temperatures of these members 12, 11 are maintained at lower levels than that of the inner pipe 10.

Figure 19:
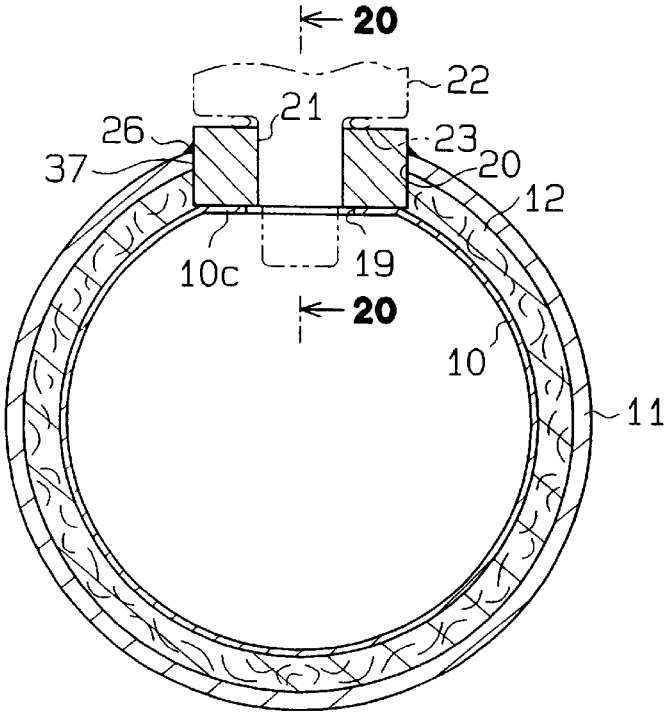
FIG. 19 is a cross-sectional view of a pipe assembly according to a seventh embodiment of the invention.
Figure 20:
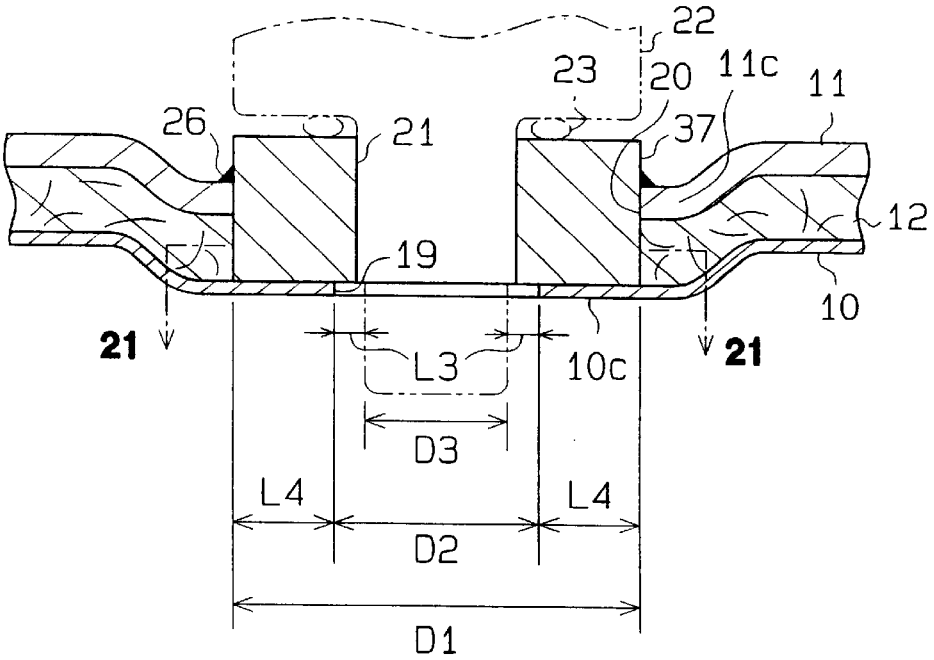
FIG. 20 is a cross-sectional view taken along the line 20—20 in FIG. 19.

Next, a seventh embodiment of the present invention will be described. As shown in FIG. 19, a cylindrical nipple 37 is located within the outer hole 20 of the outer pipe 11, and the outer surface of the nipple 37 is welded along the edge of the outer hole 20 and is fixed by the weld 26. The lower end of the nipple 37 slidably contacts the flat portion 10*c* of the inner pipe 10 around the edge of the inner hole 19. As shown in FIG. 20, the heat insulating layer 12 has a predetermined thickness (the vertical dimension in FIG. 20). The nipple 37 has at its center a connecting hole 21, and an oxygen sensor 22 is fitted in the connecting hole 21.

Figure 21:
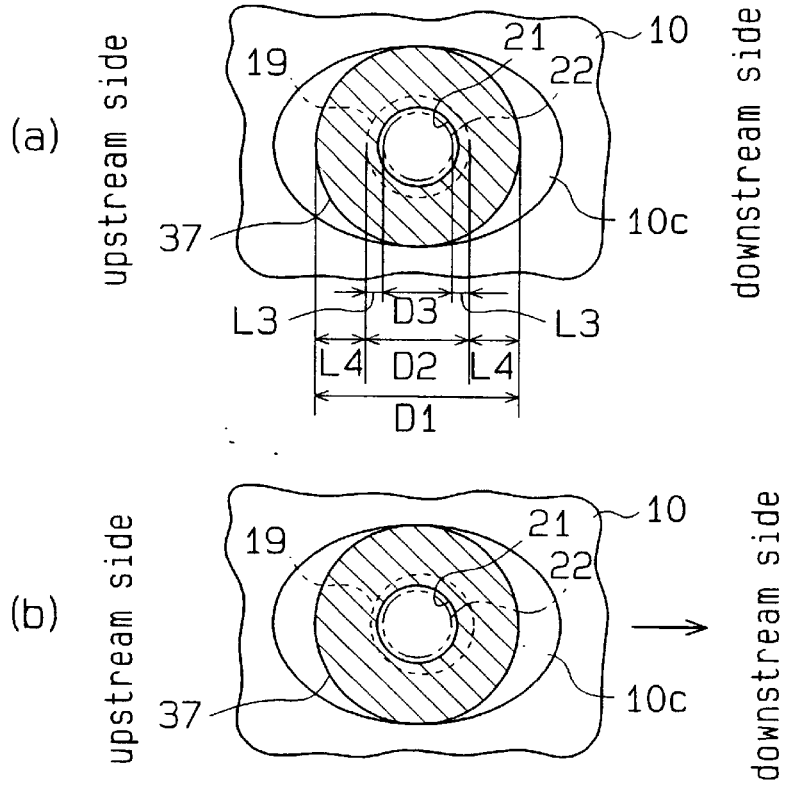
FIGS. 21(*a*),(*b*) are cross-sectional views taken along the line 21—21 in FIG. 20.

FIGS. 21(*a*),(*b*) show cross-sectional views taken along the line 21—21 in FIG. 20. As shown in FIG. 21(*a*), the following relationship is established among the outer diameter D1 of the nipple 37, the diameter D2 of the inner hole 19 and the outer diameter D3 at the inner end of the oxygen sensor 22: D3<D2<D1. The inner end of the oxygen sensor 22 is within the inner hole 19 with a clearance L3 between them, and the inner hole 19 is smaller than the outer diameter D1 of the nipple 37. The size of the clearance L3 is set such that it is greater than the shift of the inner pipe 10 when it moves relative to the outer pipe 11 due to thermal expansion. Likewise, the length L4, which represents the overlap of the nipple 37 and the inner pipe 10 is designed to be greater than the movement of the inner pipe 10 when heated.

In this embodiment, since the heat insulating layer 12 has a predetermined thickness at the location where the nipple 37 is fixed, the transmission of heat of the exhaust gas to the outer pipe 11 is impeded. When the inner pipe 10 moves due to thermal expansion relative to the outer pipe 11 in the longitudinal direction, the lower end of the nipple 37 slides along the flat portion 10*c* around the edge of the inner hole 19 while maintaining intimate contact with the portion 10*c*. Accordingly, the positional relationship between the nipple 37, the oxygen sensor 22 and the inner hole 19 changes from the state shown in FIG. 21(*a*) to the state shown in FIG. 21(*b*).

As described above, since the clearance L3 is greater than the shift of the inner pipe 10, the inner end portion of the oxygen sensor 22 dose not interfere with the inner hole 19 even if the positional relationship among the nipple 37, the oxygen sensor 22 and the inner hole 19 is changed by the relative movement of the inner pipe 10.

Since the contact length L4 is greater than the shift of the nipple 37, the lower end of the nipple 37 keeps intimate contact with the flat portion 10*c* around the edge of the inner hole 19, even if the inner pipe 10 moves relative to the outer pipe 11 due to thermal expansion. Accordingly, an airtight seal is maintained. Consequently, the exhaust gas passing through the inner pipe 10 does not pass into the heat insulating layer 12, and also the heat insulating material in the layer 12 does not spill out.

According to this embodiment, the heat insulating property of the pipe assembly 4 is maintained like in the first embodiment, and further the following benefit is obtained.

Even if the inner pipe 10 moves relative to the outer pipe 11 due to thermal expansion, the relative movement of the inner pipe 10 does not cause interference. Accordingly, heat stress attributed to thermal expansion does not occur at the inner pipe 10, outer pipe 11, nipple 37 or welded portion 26.

In this embodiment, the omission of the extra seal ring 24 can simplifies the construction of the pipe assembly 4 and can also reduces production cost.

In the foregoing first to seventh embodiments, the exhaust pipe is embodied in a pipe assembly 4 to which an oxygen sensor 22 is fixed. Next, an eighth embodiment will be described in which the exhaust pipe is embodied in a pipe assembly 4 to which an EGR (exhaust gas recirculation) control unit is fixed. An EGR control unit is generally a unit that partly recirculates the exhaust gas discharged from the engine into the engine's air intake passage to control the quantity of exhaust gas to be recirculated.

Figure 22:
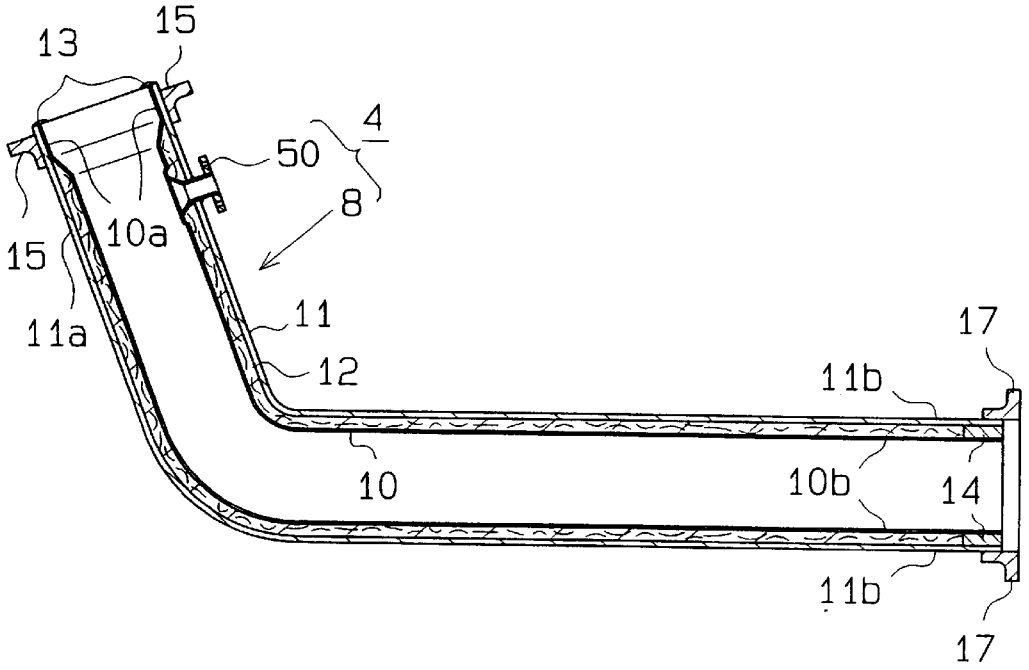
FIG. 22 is a side cross-sectional view of a pipe assembly according to an eighth embodiment of the invention.
Figure 23:
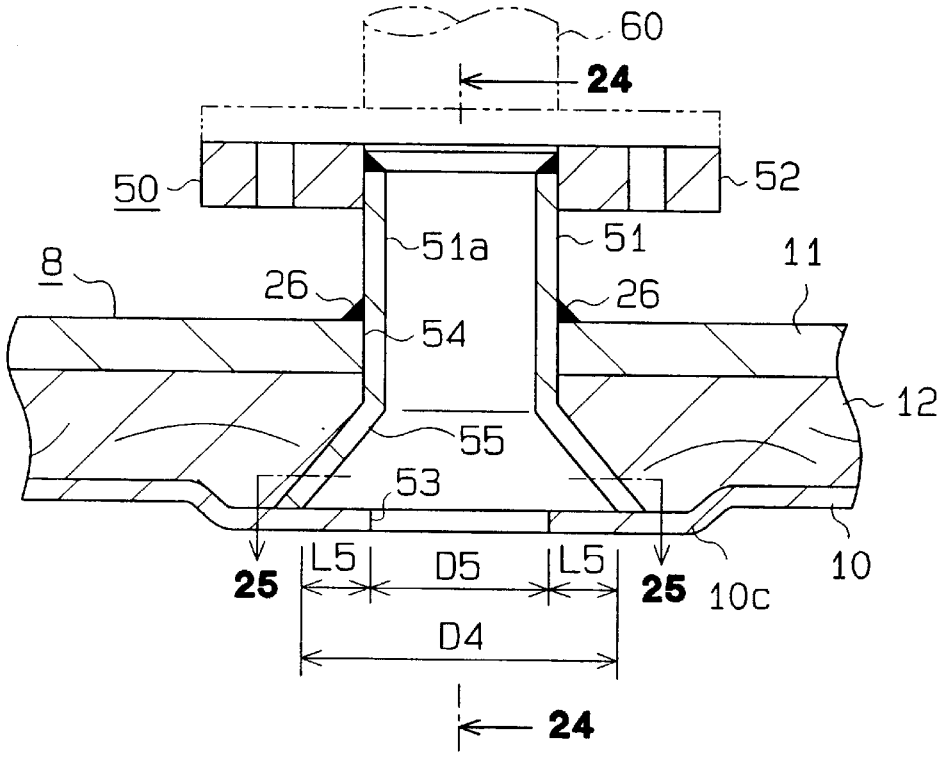
FIG. 23 is an enlarged cross-sectional view of the pipe assembly.
Figure 24:
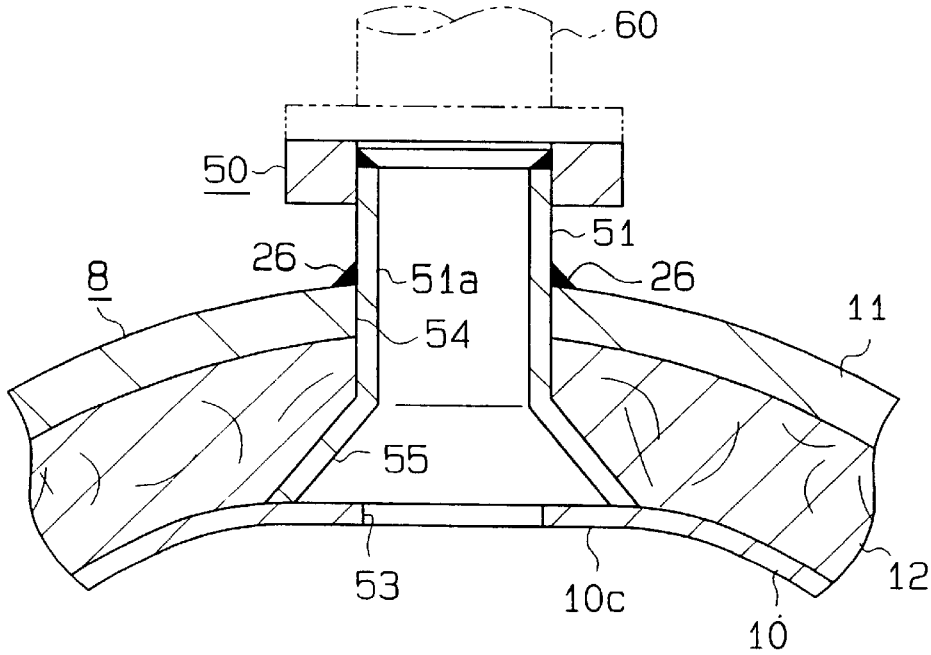
FIG. 24 is a cross-sectional view taken along the line 24—24 in FIG. 23.

As shown in FIG. 22, the pipe assembly 4 of this embodiment includes a front pipe 8 and a pipe fitting 50 attached to the pipe 8. As shown in FIG. 23 and 24, another pipe 60 for leading the exhaust gas out from the front pipe 8 is to be connected to the fitting 50. FIG. 23 shows an enlarged view of the fitting 50. As shown in FIG. 23, the fitting 50 has a substantially tubular form and contains a cylindrical portion 51 having a connecting hole 51*a* and a flange 52 welded onto the distal end of the communicating portion 51. One end of the other pipe 60 is connected to the flange 52, and exhaust gas flowing through the inner pipe 10 passes through the communicating portion 51 to be led out to the other pipe 60.

The outer pipe 11 has a outer hole 54, and the flat portion 10*c* of the inner pipe 10 has an inner hole 53 situated concentrically with the outer hole 54. The communicating portion 51 is inserted to the outer hole 54 and fixed at its outer surface by a weld 26.

As shown in FIGS. 23 and 24, the portion of the communicating portion 51 situated between the inner pipe 10 and the outer pipe 11 is an funnel portion 55 which has a funnel-like shape. The lower end of the expanded portion 55 is concentric with the inner hole 53 to surround the hole 53, and it slidably contacts the flat portion 10*c* around the edge of the hole 53. As shown in FIG. 23, the inner diameter D4 of the lower end of the expanded portion 55 is greater than the diameter D5 of the inner hole 53. The lower end of the expanded portion 55 makes contact with the flat portion 10*c* at a position spaced at a predetermined distance L5 from the edge of the inner hole 53. The distance L5 is greater than the shift of the inner pipe 10 when it moves relative to the outer pipe 11 due to thermal expansion.

In this embodiment, when the inner pipe 10 moves downstream due to thermal expansion relative to the outer pipe 11, the lower end of the expanded portion 55 slides along the flat portion 10*c* maintaining intimate contact therewith. Accordingly, movement of the inner pipe 10 relative to the outer pipe 11 does not cause interference.

Figure 25:
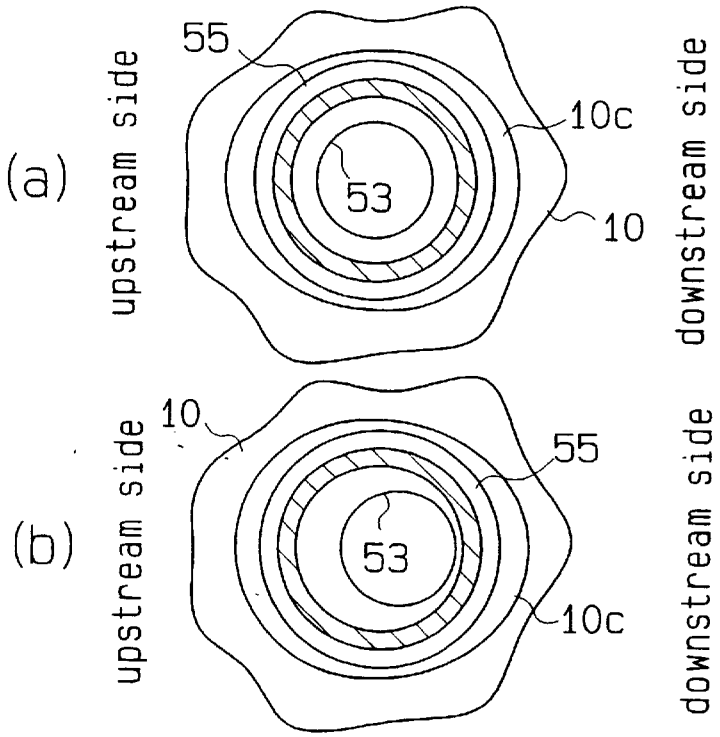
FIGS. 25(*a*),(*b*) are cross-sectional views taken along the line 25—25 in FIG. 23.

The positional relationship between the inner hole 53 and the fitting 50 is changed when relative movement of the inner pipe 10 with respect to the outer pipe 11 occurs. FIGS. 25(*a*),(*b*) show cross-sectional views taken along the line 25—25 in FIG. 23. FIG. 25(*a*) shows the positional relationship between the fitting 50 and the inner hole 53 before the inner pipe 10 moves with respect to the outer pipe 11; whereas FIG. 25(*b*) shows a positional relationship between the fitting 50 and the inner hole 53 after the inner pipe 10 has moved with respect to the outer pipe 11. In this embodiment, since the distance L5 is greater than the relative shift of the inner pipe 10, the inner hole 53 is always covered by the lower end portion of the expanded portion 55, as shown in FIG. 25(*b*), even if the positional relationship between the fitting 50 and the inner hole 53 is changed by the relative movement of the inner pipe 10.

The construction of this embodiment enjoys the following benefit effect in addition to maintaining heat insulation of the pipe assembly 4 like in the first embodiment.

Movement of the inner pipe 10 relative to the outer pipe 11 due to thermal expansion does not cause interference, so that heat stress attributed to thermal expansion does not occur at the inner pipe 10, outer pipe 11, fitting 50 or welded portion 26.

In this embodiment, the lower end of the expanded portion 55 of the fitting 50 maintains intimate contact with the flat portion 10*c* around the edge of the inner hole 53 even if the inner pipe 10 moves. Accordingly, the inner pipe 10 and the heat insulating layer 12 are sealed, and further, the exhaust gas in the inner pipe 10 does not intrude into the heat insulating layer 12. Moreover, the heat insulating material in the layer 12 can not spill out.

In this embodiment, similar advantages to those of the seal ring 24 in the first embodiment are exhibited by the fitting 50. Accordingly, the absence of the seal ring 24 simplifies the construction of the pipe assembly 4 and reduces costs.

Although only eight embodiments of the present invention have been described herein, it should be apparent to those skilled in the art that the present invention may be embodied in many other specific forms without departing from the spirit or scope of the invention. Particularly, it should be understood that the present invention may be embodied in the following manners.

While the exhaust pipe is embodied in a pipe assembly 4 in any of the foregoing embodiments, it may be used in other pipes such as the exhaust manifold 3 (including branches), the catalytic converter 5, an exhaust center pipe (not shown), the exhaust rear pipe 6, the silencer 7 or a muffler (not shown).

While an inorganic fiber such as glass wool and ceramic wool is employed as the heat insulating material in the heat insulating layer 12 in any of the foregoing embodiments, the heat insulating material may be merely an air layer.

While an integral cylindrical molded product is employed as the outer pipe 11 of the pipe assembly 4 in any of the foregoing embodiments, the outer pipe 11 may be formed by subjecting two split pipe halves to press molding to combine them into one body.

While the upstream flange 15 and the downstream flange 17 are adapted to be independent parts on the outer surface of the outer pipe 11 in any of the foregoing embodiments, sleeves integrating with flanges 15, 17 may be fitted and fixed on the inner surface of the inner pipe 10, or these flanges 15, 17 may be formed integrally with the outer pipe 11.

While the pipe assembly 4 is shown as having a three-layer structure consisting of the inner pipe 10, the heat insulating layer 12 and the outer pipe 11 in any of the foregoing embodiments, it may have a structure having four or more layers by increasing the number of insulating layers or providing a metal foil between the inner pipe 10 and the heat insulating layer 12.

Figure 26:
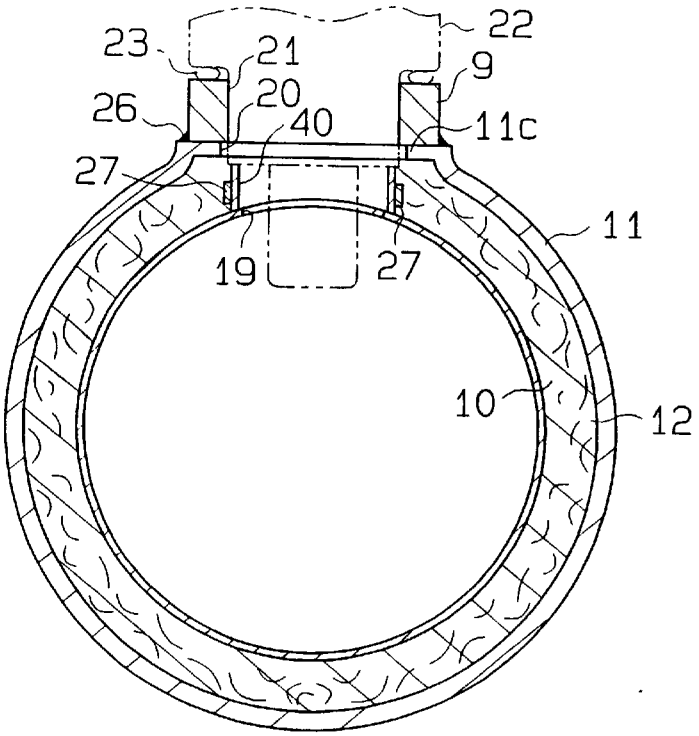
FIG. 26 is a cross-sectional view of a pipe assembly according to another embodiment of the invention.
Figure 27:
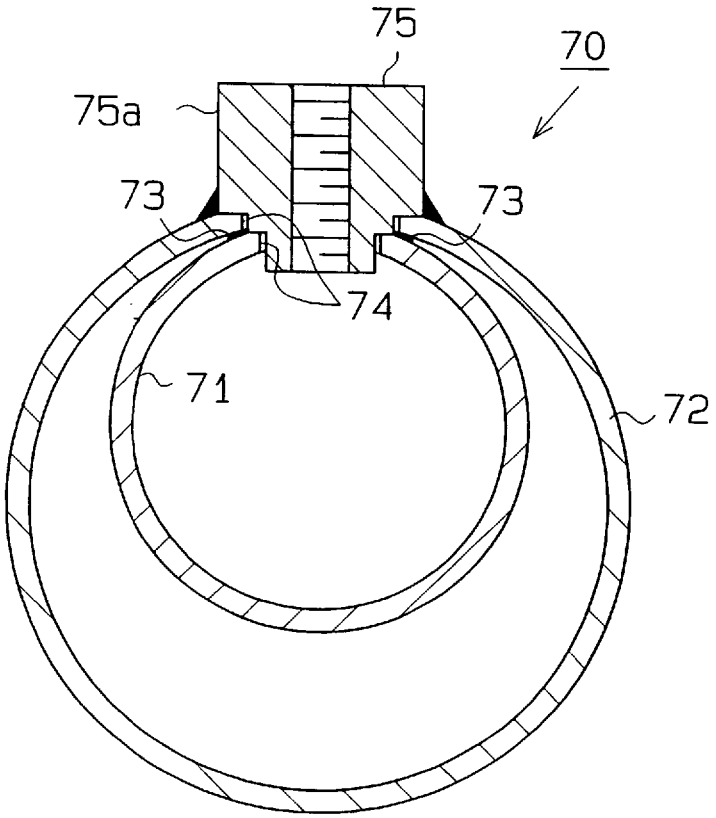
Fig.27 (Prior Art)
FIG. 27 is a cross-sectional view of an exhaust pipe according to a prior art design.

Further, as shown in FIG. 26, the flat portion 11*c* formed on the outer pipe 11 may to protrude outward. In this case, the distance between the inner pipe 10 and the outer pipe 11 is further increased at the position where the oxygen sensor 22 is to be fixed, further improving the heat insulating characteristics of the pipe assembly 4.

In the seventh and eighth embodiments, the flat portion 10*c* of the inner pipe 10 may be omitted, and the nipple 37 or the lower end of the expanded portion 55 may be allowed to have the profile of the inner pipe 10 so as to maintain intimate contact between the nipple 37 or the expanded portion 55 and the inner pipe 10.

In the eighth embodiment, instead of situating the lower end of the expanded portion 55 concentrically with the inner hole 53, the expanded portion 55 may be situated such that the clearance L5 between the lower end of the enlarged portion 55 and the inner hole 53 shown in FIG. 23 is greater on the downstream side (right side in FIG. 23) than on the upstream side.

The nipples 9, 37 employed for fitting the oxygen sensor 22 in any of the foregoing embodiments may be used for fitting other sensors or for introducing secondary air.

Therefore, the present examples and embodiments are to be considered as illustrative and not restrictive, and the invention is not to be limited to the details given herein, but may be modified within the scope of the appended claims.

What is claimed is:

1. An exhaust pipe having an outer pipe, an inner pipe extending in the outer pipe, said inner pipe permitting a passage of exhaust gas therethrough, said outer pipe and said inner pipe respectively having an outer hole and an inner hole aligned with each other, said outer pipe having an outer surface and an inner surface around a peripheral edge of the outer hole, said inner pipe having an outer surface and an inner surface around a peripheral edge of the inner hole, an outer surface of the inner pipe being separated from an inner surface of the outer pipe by a space along a substantially entire length of the inner pipe and the outer pipe, a cylindrical member secured to the outer pipe in alignment with the outer hole, and said cylindrical member having a connecting hole axially extending through the member to connect an external member with an inner space of the inner pipe, wherein said connecting hole connects with the inner space of the inner pipe by way of the outer hole and the inner hole, and wherein said inner pipe is axially movable relative to the outer pipe based on a thermal expansion of the inner pipe resulting from the exhaust gas, said exhaust pipe comprising:

seal means for sealing between the inner hole and the outer hole, said seal means being interposed between the outer surface of the inner pipe around the peripheral edge of the inner hole and the external member inserted into the connecting hole, wherein said seal means contacts the external member, wherein said seal means is in slidable contact with said outer surface around the peripheral edge of the inner hole to facilitate the movement of the inner pipe relative to the outer pipe, and wherein said seal means includes a sleeve having an upper end and a lower end, said upper end engaging the external member and said lower end being radially outward bent to slidably contact said outer surface around the peripheral edge of the inner hole.

2. The exhaust pipe as set forth in claim 1, wherein said seal means is elastically deformable in a radial direction with respect to the outer pipe and the inner pipe.

3. The exhaust pipe as set forth in claim 1 further including a heat insulator interposed between the outer pipe and the inner pipe.

4. The exhaust pipe as set forth in claim 1, wherein said outer pipe and said inner pipe respectively have first ends connected to each other and second ends movable relative to each other.

5. The exhaust pipe as set forth in claim 1, wherein said external member includes an oxygen sensor for detecting an oxygen concentration in the exhaust gas flowing within the inner pipe.

6. An exhaust pipe having an outer pipe, an inner pipe extending in the outer pipe, said inner pipe permitting a passage of exhaust gas therethrough, said outer pipe and said inner pipe respectively having an outer hole and an inner hole aligned with each other, said outer pipe having an outer surface and an inner surface around a peripheral edge of the outer hole, said inner pipe having an outer surface and an inner surface around a peripheral edge of the inner hole, an outer surface of the inner pipe being separated from an inner surface of the outer pipe by a space along a substantially entire length of the inner pipe and the outer pipe, a cylindrical member secured to the outer pipe in alignment with the outer hole, and said cylindrical member having a connecting hole axially extending through the member to connect an external member with an inner space of the inner pipe, wherein said connecting hole connects with the inner space of the inner pipe by way of the outer hole and the inner hole, and wherein said inner pipe is axially movable relative to the outer pipe based on a thermal expansion of the inner pipe resulting from the exhaust gas, said exhaust pipe comprising:

seal means for sealing between the inner hole and the outer hole, said seal means being interposed between the outer surface of the inner pipe around the peripheral edge of the inner hole and the external member inserted into the connecting hole, wherein said seal means contacts the external member, wherein said seal means being arranged to facilitate the movement of the inner pipe relative to the outer pipe and wherein said peripheral edge of the inner hole is bent to form the seal means integral with the inner pipe.

7. The exhaust pipe as set forth in claim 1, wherein said peripheral edge of the outer hole is bent to form the seal means integral with the outer pipe, said seal means being arranged to move relative to the outer surface around the peripheral edge of the inner hole.

8. The exhaust pipe as set forth in claim 1, wherein said seal means includes a sleeve formed of a wire mesh.

9. An exhaust pipe having an outer pipe, an inner pipe extending in the outer pipe, said inner pipe permitting a passage of exhaust gas therethrough, said outer pipe and said inner pipe respectively having an outer hole and an inner hole aligned with each other, said outer pipe having an outer surface and an inner surface around a peripheral edge of the outer hole, said inner pipe having an outer surface and an inner surface around a peripheral edge of the inner hole, an outer surface of the inner pipe being separated from an inner surface of the outer pipe by a space along a substantially entire length of the inner pipe and the outer pipe, a cylindrical member secured to the outer pipe in alignment with the outer hole, and said cylindrical member having a connecting hole axially extending through the member to connect an external member with an inner space of the inner pipe, wherein said connecting hole connects with the inner space of the inner pipe by way of the outer hole and the inner hole, and wherein said inner pipe is axially movable relative to the outer pipe based on a thermal expansion of the inner pipe resulting from the exhaust gas, said exhaust pipe comprising:

seal means for sealing between the inner hole and the outer hole, said seal means being interposed between the outer surface of the inner pipe around the peripheral edge of the inner hole and the external member inserted into the connecting hole, wherein said seal means contacts the external member, wherein said seal means is in slidable contact with said outer surface around the peripheral edge of the inner hole to facilitate the movement of the inner pipe relative to the outer pipe, and wherein said seal means includes a sleeve formed of a wire mesh, the exhaust pipe further including a metal ring mounted on an outer edge of the sleeve.

10. An exhaust pipe having an outer pipe, an inner pipe extending in the outer pipe, said inner pipe permitting a passage of exhaust gas therethrough, said outer pipe and said inner pipe respectively having an outer hole and an inner hole aligned with each other, said outer pipe having an outer surface and an inner surface around a peripheral edge of the outer hole, said inner pipe having an outer surface and an inner surface around a peripheral edge of the inner hole, an outer surface of the inner pipe being separated from an inner surface of the outer pipe by a space along a substantially entire length of the inner pipe and the outer pipe, a cylindrical member secured to the outer pipe in alignment with the outer hole, wherein said cylindrical member includes a sleeve portion and a flange portion provided on the sleeve portion, said sleeve portion extending through said inner hole and said outer hole, and said flange portion being secured to the outer pipe, and said cylindrical member having a connecting hole axially extending through the member to connect an external member with an inner space of the inner pipe, wherein said connecting hole connects with the inner space of the inner pipe by way of the outer hole and the inner hole, and wherein said inner pipe is axially movable relative to the outer pipe based on a thermal expansion of the inner pipe resulting from the exhaust gas, said exhaust pipe comprising:

seal means for sealing between the inner hole and the outer hole, said seal means being interposed between the outer surface around the peripheral edge of the inner hole and the cylindrical member secured to the outer pipe; and said seal means being in slidable contact with at least one of the outer surface around the peripheral edge of the inner hole and the cylindrical member.

11. The exhaust pipe as set forth in claim 10, wherein said seal means is interposed between the outer surface around the peripheral edge of the inner hole and the inner surface around the peripheral edge of the outer hole, said seal means is in slidable contact with at least the outer surface around the peripheral edge of the inner hole.

12. The exhaust pipe as set forth in claim 10, wherein said seal means is interposed between the outer surface around the peripheral edge of the inner hole and the flange portion through the outer hole, said seal means is in slidable contact with at least one of the outer surface around the peripheral edge of the inner hole and the flange portion.

13. The exhaust pipe as set forth in claim 10, wherein said seal means is elastically deformable in a radial direction with respect to the outer pipe and the inner pipe.

14. The exhaust pipe as set forth in claim 10, wherein said seal means is formed of a wire mesh.

15. The exhaust pipe as set forth in claim 10, wherein said sleeve portion and said peripheral edge of the inner hole define a first gap and a second gap respectively disposed upstream and downstream in respect with a flowing direction of the exhaust gas in the inner pipe, said second gap being smaller than the first gap.

16. An exhaust pipe having an outer pipe, an inner pipe extending in the outer pipe, said inner pipe permitting a passage of exhaust gas therethrough, said outer pipe and said inner pipe respectively having an outer hole and an inner hole aligned with each other, said outer pipe having an outer surface and an inner surface around a peripheral edge of the outer hole, said inner pipe having an outer surface and an inner surface around a peripheral edge of the inner hole, an outer surface of the inner pipe being separated from an inner surface of the outer pipe by a space along the substantially entire length of the inner pipe and the outer pipe, a cylindrical member secured to the outer pipe in alignment with the outer hole, and said cylindrical member having a connecting hole axially extending through the member to connect an external member with an inner space of the inner pipe, wherein said connecting hole connects with the inner space of the inner pipe by way of the outer hole and the inner hole, and wherein said outer pipe has a first end and a second end respectively disposed upstream and downstream with respect to a flowing direction of the exhaust gas, and said inner pipe has a third end and a fourth end respectively disposed upstream and downstream with respect to the flowing direction of the exhaust gas, and wherein said first end and said third end are connected to each other and said second end and said fourth end are movable relative to each other, said inner pipe being axially movable relative to the outer pipe based on a thermal expansion of the inner pipe resulting from the exhaust gas, said exhaust pipe comprising:

seal means for sealing between the inner hole and the outer hole, said seal means being interposed between the outer surface around the peripheral edge of the inner hole and the cylindrical member secured to the outer pipe; and said seal means being in slidable contact with at least one of the outer surface around the peripheral edge of the inner hole and the cylindrical member.

17. The exhaust pipe as set forth in claim 10, wherein said external member includes an oxygen sensor for detecting an oxygen concentration in the exhaust gas flowing within the inner pipe.

18. An exhaust pipe having an outer pipe, an inner pipe extending in the outer pipe, said inner pipe permitting a passage of exhaust gas therethrough, said outer pipe and said inner pipe respectively having an outer hole and an inner hole aligned with each other, said outer pipe having an outer surface and an inner surface around a peripheral edge of the outer hole, said inner pipe having an outer surface and an inner surface around a peripheral edge of the inner hole, an outer surface of the inner pipe being separated from an inner surface of the outer pipe by a space along the substantially entire length of the inner pipe and the outer pipe, a cylindrical member secured to the outer pipe in alignment with the outer hole, and said cylindrical member having a connecting hole axially extending through the member to connect an external member with an inner space of the inner pipe, wherein said connecting hole connects with the inner space of the inner pipe by way of the outer hole and the inner hole, and wherein said inner pipe is axially moveable relative to the outer pipe based on a thermal expansion of the inner pipe resulting from the exhaust gas, said exhaust pipe comprising:

said cylindrical member being inserted into the outer hole;

said cylindrical member having an end surface, wherein said end surface slidably contacts said outer surface around the peripheral edge of the inner hole;

said connecting hole of the cylindrical member having a peripheral edge; and said inner hole having a diameter larger than a diameter of the connecting hole and disposed so as to keep said peripheral edge of the connecting hole apart said peripheral edge of the inner hole.

19. The exhaust pipe as set forth in claim 18 further including a heat insulator interposed between the outer pipe and the inner pipe.

20. The exhaust pipe as set forth in claim 18, wherein said outer pipe and said inner pipe respectively have first ends connected to each other and second ends movable relative to each other.

21. The exhaust pipe as set forth in claim 18, wherein said external member includes an oxygen sensor for detecting an oxygen concentration in the exhaust gas flowing within the inner pipe.

22. An exhaust pipe having an outer pipe, an inner pipe extending in the outer pipe, said inner pipe permitting a passage of exhaust gas therethrough, said outer pipe and said inner pipe respectively having an outer hole and an inner hole aligned with each other, said outer pipe having an outer surface and an inner surface around a peripheral edge of the outer hole, said inner pipe having an outer surface and an inner surface around a peripheral edge of the inner hole, an outer surface of the inner pipe being separated from an inner surface of the outer pipe by a space along the substantially entire length of the inner pipe and the outer pipe, a cylindrical member secured to the outer pipe in alignment with the outer hole, and said cylindrical member having a connecting hole axially extending through the member to connect an external member with an inner space of the inner pipe, wherein said connecting hole connects with the inner space of the inner pipe by way of the outer hole and the inner hole, and wherein said inner pipe is axially moveable relative to the outer pipe based on a thermal expansion of the inner pipe resulting from the exhaust gas, said exhaust pipe comprising:

said cylindrical member being inserted into the outer hole;

said cylindrical member having an end surface, wherein said end surface slidably contact said outer surface around the peripheral edge of the inner hole; and said cylindrical member including a pipe joint having a cylindrical portion and a funnel portion outwardly flared form the cylindrical portion, wherein said cylindrical portion is fitted within the outer hole and wherein said funnel portion includes the end surface surrounding the inner hole.

23. The exhaust pipe as set forth in claim 22 further comprising:

said cylindrical portion and said funnel portion respectively having a first hole and a second hole, wherein said first hole and said second hole form said connecting hole of the cylindrical member each other;

said second hole having a peripheral edge; and said inner hole having a diameter smaller than a diameter of the second hole and disposed so as to keep said peripheral edge of the second hole apart said peripheral edge of the inner hole.

24. The exhaust pipe as set forth in claim 22 further including a heat insulator interposed between the outer pipe and the inner pipe.

25. The exhaust pipe as set forth in claim 22, wherein said outer pipe and said inner pipe respectively have first ends connected to each other and second ends movable relative to each other.

26. The exhaust pipe as set forth in claim 22, wherein said external member includes an additional pipe connected to said pipe joint to discharge the exhaust gas flowing in the inner pipe.

* * * * *